US012295403B2

(12) United States Patent
Carroll et al.

(10) Patent No.: US 12,295,403 B2
(45) Date of Patent: May 13, 2025

(54) TOBACCO BEADS

(71) Applicant: Altria Client Services LLC, Richmond, VA (US)

(72) Inventors: Andrew Nathan Carroll, Chester, VA (US); Yan Helen Sun, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 308 days.

(21) Appl. No.: 17/887,686

(22) Filed: Aug. 15, 2022

(65) Prior Publication Data

US 2022/0386678 A1 Dec. 8, 2022

Related U.S. Application Data

(63) Continuation of application No. 17/005,571, filed on Aug. 28, 2020, now Pat. No. 11,445,744, which is a continuation of application No. 15/715,806, filed on Sep. 26, 2017, now Pat. No. 10,827,777.

(60) Provisional application No. 62/400,409, filed on Sep. 27, 2016.

(51) Int. Cl.

| | |
|---|---|
| ***A24B 13/00*** | (2006.01) |
| ***A24B 3/14*** | (2006.01) |
| ***A24B 15/14*** | (2006.01) |
| ***A24B 15/18*** | (2006.01) |
| ***A24B 15/28*** | (2006.01) |
| *A24B 15/30* | (2006.01) |

(52) U.S. Cl.

CPC ..... *A24B 3/14* (2013.01); *A24B 13/00* (2013.01); *A24B 15/14* (2013.01); *A24B 15/186* (2013.01); *A24B 15/283* (2013.01); *A24B 15/30* (2013.01)

(58) Field of Classification Search

None

See application file for complete search history.

(56) References Cited

U.S. PATENT DOCUMENTS

| | | | |
|---|---|---|---|
| 4,516,590 | A | 5/1985 | Teng |
| 4,528,993 | A | 7/1985 | Sensabaugh, Jr. et al. |
| 4,660,577 | A | 4/1987 | Sensabaugh et al. |
| 4,848,373 | A | 7/1989 | Lenkey |

(Continued)

FOREIGN PATENT DOCUMENTS

WO WO-2015/092749 A1 6/2015

OTHER PUBLICATIONS

Partial European Search Report dated Nov. 16, 2023, issued in corresponding European patent application No. EP23187077.

(Continued)

*Primary Examiner* — Eric Yaary

(74) *Attorney, Agent, or Firm* — Harness, Dickey & Pierce, P.L.C.

(57) ABSTRACT

A smokeless tobacco product described herein includes at least one tobacco bead. Tobacco beads described herein include a core and at least one tobacco-containing layer surrounding the core. Each tobacco-containing layer can include less than 10 weight percent tobacco. Tobacco bead described herein can have a diameter of at least 1 millimeters. Tobacco bead described herein can have at least 5 mg tobacco. Tobacco bead described herein can have an oven volatiles content of between 2 weight percent and 10 weight percent. Tobacco bead described herein can have an outer shell.

20 Claims, 11 Drawing Sheets

(56) References Cited

U.S. PATENT DOCUMENTS

| | | | | |
|---|---|---|---|---|
| 4,987,907 | A | 1/1991 | Townend | |
| 5,372,149 | A | 12/1994 | Roth et al. | |
| 5,380,717 | A | 1/1995 | Ohkuma et al. | |
| 5,410,035 | A | 4/1995 | Wakabayashi et al. | |
| 6,797,291 | B2 * | 9/2004 | Richardson | A61P 43/00 426/601 |
| 2004/0118422 | A1 | 6/2004 | Lundin et al. | |
| 2005/0089548 | A1 | 4/2005 | Virgalitto et al. | |
| 2005/0178398 | A1 | 8/2005 | Breslin et al. | |
| 2006/0191548 | A1 | 8/2006 | Strickland et al. | |
| 2007/0186942 | A1 | 8/2007 | Strickland et al. | |
| 2008/0029110 | A1 | 2/2008 | Dube et al. | |
| 2008/0209586 | A1 | 8/2008 | Nielsen et al. | |
| 2010/0018883 | A1 | 1/2010 | Patel | |
| 2010/0170522 | A1 | 7/2010 | Sun et al. | |
| 2012/0055494 | A1 | 3/2012 | Hunt et al. | |
| 2012/0118310 | A1 | 5/2012 | Cantrell et al. | |
| 2013/0206150 | A1 | 8/2013 | Duggins et al. | |
| 2013/0340776 | A1 | 12/2013 | Mishra et al. | |
| 2014/0227388 | A1 | 8/2014 | Nissen | |
| 2017/0119041 | A1 | 5/2017 | Hufnagel et al. | |

OTHER PUBLICATIONS

Tso (1999, Chapter 1 in Tobacco, Production, Chemistry and Technology, Davis and Nielsen, eds., Blackwell Publishing, Oxford).

International Search Report and Written Opinion in International Application No. PCT/US2017/053449, dated Apr. 9, 2018, 19 pages.

International Preliminary Report on Patentability and Written Opinion for corresponding Application No. PCT/US2017/053449 dated Apr. 2, 2019.

European Office Action for corresponding Application No. 17781279.9-1105 dated Sep. 14, 2020.

Extended European Search Report dated Apr. 4, 2024, issued in corresponding European Patent Application No. 2317077.5.

* cited by examiner

Each error bar is constructed using 1 standard error from the mean.

TOBACCO BEADS

CROSS-REFERENCE TO RELATED APPLICATIONS

This application is a continuation of U.S. application Ser. No. 17/005,571, filed Aug. 28, 2020, which is a continuation of U.S. application Ser. No. 15/715,806, filed Sep. 26, 2017, which claims priority to U.S. Provisional Application No. 62/400,409, filed on Sep. 27, 2016, the entire contents of each of which are incorporated herein by reference.

TECHNICAL FIELD

This invention relates to tobacco beads and smokeless tobacco products including tobacco beads.

BACKGROUND

Tobacco can be enjoyed by adult tobacco consumers in a variety of forms. Smoking tobacco is combusted and the aerosol either tasted or inhaled (e.g., in a cigarette, cigar, or pipe). Smokeless tobacco products are not combusted and include: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form, and it is typically packaged in round cans and used as a pinch or in a pouch placed between an adult tobacco consumer's cheek and gum. Snus is a heat treated smokeless tobacco. Dry snuff is finely ground tobacco that is placed in the mouth or used nasally.

SUMMARY

Tobacco beads provided herein include a core and at least one tobacco-containing layer surrounding the core. Tobacco beads provided herein can be adapted for use either alone or as part of a larger smokeless tobacco product by an adult tobacco consumer. In some cases, tobacco beads provided herein have a diameter of at least 6 millimeters and include at least 30 mg tobacco. Tobacco beads provided herein can have a maximum concentration of tobacco in any layer of less than 15 weight percent. In some cases, tobacco beads provided herein can have an oven volatiles content of between 2 weight percent and 10 weight percent. In some cases, tobacco beads provided herein can include an outer shell. Tobacco beads provided herein can provide an adult tobacco consumer with a satisfying tobacco experience.

Tobacco beads provided herein can include between 30 mg and 100 mg of tobacco. In some cases, tobacco beads provided herein include at least one tobacco-containing layer including at least 5 weight percent tobacco. In some cases, each tobacco-containing layer includes less than 15 weight percent tobacco, less than 14 weight percent tobacco, less than 13 weight percent tobacco, less than 12 weight percent tobacco, or less than 11 weight percent tobacco. In some cases, each tobacco-containing layer includes between 5 weight percent tobacco and 14 weight percent tobacco, between 8 weight percent tobacco and 12 weight percent tobacco, or between 10 weight percent tobacco and 11 weight percent tobacco. The tobacco can be a tobacco powder having an average particle size of less than 500 micrometers, less than 400 micrometers, less than 300 micrometers, less than 250 micrometers, less than 200 micrometers, less than 150 micrometers, less than 100 micrometers, less than 50 micrometers, less than 40 micrometers, or less than 30 micrometers. In some cases, a maximum particle size for a tobacco powder used in a tobacco bead provided herein can be less than 1 millimeter, less than 500 micrometers, less than 400 micrometers, less than 300 micrometers, less than 250 micrometers, less than 200 micrometers, less than 150 micrometers, or less than 120 micrometers. For example, a tobacco powder used in an exemplary embodiment of a tobacco bead can have an average particle size of about 27 micrometers and a largest particle size of about 120 micrometers. Tobacco used in a tobacco bead provided herein can be a cured tobacco prepared from plants having less than 20 μg of DVT per $cm^2$ of green leaf tissue.

One or more tobacco-containing layers surrounding the core are adapted to dissolve within an adult tobacco consumer's mouth. In addition to tobacco, the one or more tobacco-containing layers can include one or more flavorants, pH adjusters, sweeteners, fillers, plasticizers, emulsifiers, binders, pigments, surfactants, lipids, and/or disintegrators. The one or more tobacco-containing layers can also include water and/or other volatiles. In some cases, a tobacco-containing layer can include ingredients selected from the group consisting of starch, konjac, collagen, inulin, soy protein, whey protein, casein, wheat gluten, carrageenan, alginates, propylene glycol alginate, xanthan, dextran, pullulan, curdlan, gellan, locust bean gum, guar gum, gum arabic, tara gum, gum tragacanth, pectin, agar, zein, karaya, gelatin, *psyllium* seed, chitin, chitosan, gum *acacia*, polyvinyl pyrrolidone, polyethylene oxide, polyvinyl alcohol, soluble fiber (e.g., maltodextrin), sugar alcohols (e.g., mannitol, sorbitol), polysorbates, and/or salts. Suitable salts include sodium chloride, citric acid salt, monosodium glutamate, and sodium carbonate. Suitable plasticizers include propylene glycol, triacetin, glycerin, vegetable oil, triglycerides, or a combination thereof. Suitable sweeteners include both natural and artificial sweeteners. Suitable natural sweeteners include sugars, for example, monosaccharides, disaccharides, and/or polysaccharide sugars, and/or mixtures of two or more sugars. In some cases, a tobacco bead provided herein includes one or more of the following: sucrose or table sugar; honey or a mixture of low molecular weight sugars not including sucrose; glucose or grape sugar or corn sugar or dextrose; molasses; corn sweetener; corn syrup or glucose syrup; fructose or fruit sugar; lactose or milk sugar; maltose or malt sugar or maltobiose; sorghum syrup; mannitol or manna sugar; sorbitol or d-sorbite or d-sobitol; fruit juice concentrate; and/or mixtures or blends of one or more of these ingredients. A tobacco bead provided herein an also include non-nutritive sweeteners. Suitable non-nutritive sweeteners include: *stevia*, saccharin; aspartame; sucralose; or acesulfame potassium.

Tobacco beads provided herein can include starch, both in the core and/or in tobacco-containing layers. In some cases, a tobacco bead provided herein includes starch. In some cases, one or more tobacco-containing layers can include at least 20 weight percent starch. In some cases, each tobacco-containing layer includes between 20 weight percent and 50 weight percent of starch. The mixture of starch and tobacco in amounts provided herein can inhibit throat burn and/or site burn while still providing an adult tobacco consumer with a satisfying tobacco experience. Tobacco-containing layers provided herein, for example, can provide a satisfying tobacco taste and a satisfying flavor profile.

Tobacco beads provided herein can include sugar alcohols. In some cases, a tobacco bead provided herein can include one or more sugar alcohols. Exemplary sugar alcohols include sorbitol, mannitol, xylitol, and erythritol. In some cases, one or more tobacco-containing layers can include at least 25 weight percent of one or more sugar alcohols. In some cases, each tobacco-containing layer includes between 25 weight percent and 50 weight percent of one or more sugar alcohols. In some cases, each tobacco-containing layer includes between 30 weight percent and 50 weight percent of one or more sugar alcohols. In some cases, one or more tobacco-containing layers can include at least 25 weight percent of mannitol. In some cases, each tobacco-containing layer includes between 25 weight percent and 50 weight percent of mannitol. In some cases, each tobacco-containing layer includes between 30 weight percent and 50 weight percent of mannitol. The mixture of the sugar alcohol(s), starch, and tobacco in amounts provided herein can inhibit throat burn and/or site burn while still providing an adult tobacco consumer with a satisfying tobacco experience. Tobacco-containing layers provided herein, for example, can provide a satisfying tobacco taste and a satisfying flavor profile.

Tobacco beads provided herein can include soluble fiber. In some cases, one or more tobacco-containing layers can include between 1 weight percent and 20 weight percent soluble fiber, between 5 weight percent and 15 weight percent of soluble fiber, or between 8 weight percent and 10 weight percent of soluble fiber. Suitable soluble fiber includes maltodextrin, *psyllium*, pectin, guar gum, gum arabic, inulin, arabinoxylans, cellulose, and many other plant components such as resistant starch, resistant dextrins, lignin, pectins, beta-glucans, and oligosaccharides or a combination thereof. In some cases, a tobacco bead provided herein can include a digestion-resistant soluble fiber. A digestion resistant soluble fiber can include starch linkages that remain undigested by enzymes of the human digestive tract. In some cases, a tobacco bead provided herein can include a digestion-resistant maltodextrin. Suitable maltodextrins can include those that are soluble in water up to 70% at 20° C., have a viscosity of about 15 cps for a 30% solution at 30° C., a DE in the range of about 6-16, and contain random α-1,2, α-1,3, α-1,4, β-1,2, β-1,3 and β-1,4 glucose linkages in addition to the normal α-1,4 glucose linkages found in partially hydrolyzed starch. See, e.g., U.S. Pat. Nos. 5,410,035 and 5,380,717, which are hereby incorporated by reference.

The core can have a diameter of between 300 micrometers and 7 millimeters. In some cases, a core in a tobacco bead provided herein can be between 400 micrometers and 4 millimeters, between 500 micrometers and 3 millimeters, or between 1 millimeter and 2 millimeter in diameter. In some cases, the core is substantially free of tobacco. For example, the core can include a carbohydrate (e.g., sugar), a water soluble polymer, a flavorant, a salt, filler (e.g., starch), or a combination thereof. In some cases, the core can include starch, sugar, and optionally one or more flavorants. In some cases, the core can include a gel. For example, the core can include gelatin, one or more flavorants, and optionally a sweetener. In some cases, the core makes up between 2 weight percent and 20 weight percent of the tobacco bead, between 5 weight percent and 10 weigh percent of the tobacco bead, or between 6 weight percent and 8 weight percent of the tobacco bead.

An outer shell can be provided on a tobacco bead provided herein. The outer shell can serve as a moisture barrier to inhibit volatiles from escaping from the tobacco bead provided herein. The outer shell can, in some cases, provide a glossy or semi-glossy appearance, a smooth surface, and/or an appealing visual aesthetic (e.g., a nice color). In some cases, the outer shell can include binders, sweeteners, emulsifiers, plasticizers, sweeteners, and/or flavorants. In some cases, an outer shell can provide a hard outer coating. For example, a binder selected from the group consisting of methylcellulose, hydroxypropyl methylcellulose, carboxymethyl cellulose, and/or ethyl cellulose can provide a hard outer coating. In some cases, the outer shell can provide a soft mouth feel. For example, a binder selected from the group consisting of Beeswax, Zein, acetylated monoglyceride, and/or hydroxypropylated potato starch can provide a soft mouth feel. In some cases, the outer shell includes a colorant, such as titanium dioxide.

Tobacco beads provided herein can be generally spherical. Additional shapes can be molded using the same process prior to drying. Drying will set the shape once the product is dried. In some cases, tobacco beads provided herein have a diameter of between 7 millimeters and 30 millimeters. In some cases, tobacco beads provided herein have a diameter of between 7 millimeters and 12 millimeters and have a total tobacco content of between 40 mg and 70 mg. For example, a tobacco bead having a diameter of about 8 mm can have a total tobacco content of about 42 mg. In another example of a tobacco bead provided herein, a tobacco bead having a diameter of about 10 mm can have a total tobacco content of about 60 mg.

Tobacco beads provided herein can include one or more flavorants, which can be present in any internal layer (e.g., a tobacco-containing layer), an outer shell, or the core. For example, suitable flavorants can include licorice, wintergreen, cherry and berry type flavorants, Dramboui, bourbon, scotch, whiskey, spearmint, peppermint, lavender, cinnamon, *cardamon*, caramel, *apium* graveolents, clove, *cascarilla*, nutmeg, sandalwood, bergamot, *geranium*, honey essence, honey, rose oil, *vanilla*, lemon oil, orange oil, Japanese mint, *cassia*, caraway, cognac, jasmin, chamomile, menthol, ilangilang, sage, fennel, piment, ginger, *anise*, coriander, coffee, mint oils from a species of the genus *Mentha*, honey, and combinations thereof. Some flavorants, such as honey, can serve as both a flavorant and a sweetener.

Tobacco beads provided herein can include a flavor profile having two or more different flavors each having a peak flavor intensity being perceptible at different times or concurrently during consumption. For example, the different tobacco-containing layers can include different flavorants, sweeteners, and/or tobacco concentrations.

Tobacco beads provided herein can be produced by fluidizing a plurality of cores within a fluid bed processor having a rotor, feeding a dry ingredients (e.g., starch, mannitol, tobacco particles, soluble fiber, etc.) into the fluidized bed, and spraying a binder solution into the fluidized bed containing the fluidized cores. The binding solution can include sweeteners, flavorants, plasticizers, and/or additional ingredients. The core can further be coated by spraying additional binder solution and introducing additional dry ingredients into the fluidized bed after spraying the first binding solution to produce at least two concentric layers surrounding the core, which can have the same composition or different compositions.

The details of one or more embodiments of tobacco beads, and smokeless tobacco products including the same, are set forth in the accompanying drawings and the description below. Other features, objects, and advantages will be apparent from the description and drawings, and from the claims.

DETAILED DESCRIPTION

Figure 1:
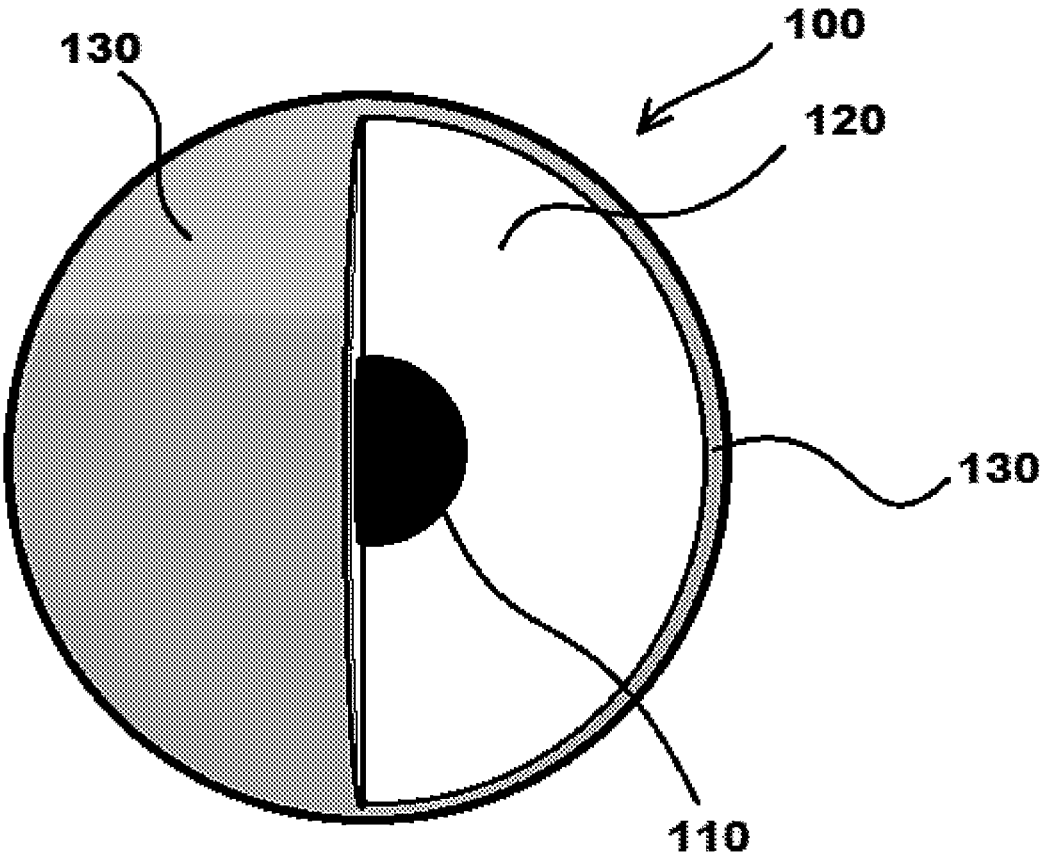
FIG. 1 depicts a cut-out view of an exemplary tobacco bead provided herein.

Tobacco beads provided herein can provide an adult tobacco consumer with a satisfying tobacco experience while inhibiting throat burn and/or site burn. FIG. 1 depicts a cut-out view of an exemplary tobacco bead 100. Tobacco beads provided herein include at least a core 110 and at least one tobacco-containing layer 120. Tobacco beads provided herein can also include an outer shell 130. As shown in FIG. 1, tobacco beads 100 provided herein can be generally spherical. In some cases, however, tobacco beads can be oblong, egg-shaped, or any other suitable shape. As shown, tobacco bead 100 includes a single tobacco-containing layer 120. In some cases, however, tobacco beads provided herein can include multiple tobacco-containing layers surrounding the core (and internal to the outer shell), with each layer having a different composition (e.g., different flavorants). In some cases, a smokeless tobacco product can consist of one tobacco bead provided herein. In some cases, a smokeless tobacco product can include one or more tobacco beads combined with additional components.

Core 110, tobacco-containing layer 120, and/or outer shell 130 can each include one or more flavorants. Flavorants can produce a flavor release profile when the tobacco beads 100 are orally consumed by an adult tobacco consumer. Flavorants used within the tobacco beads 100 can be any flavorant known in the art. For example, suitable flavorants include wintergreen, cherry and berry type flavorants, various liqueurs and liquors such as Dramboui, bourbon, scotch, whiskey, spearmint, peppermint, lavender, caramel, cinnamon, *cardamon, apium* graveolents, clove, *cascarilla*, nutmeg, sandalwood, bergamot, *geranium*, honey essence, honey, rose oil, *vanilla*, lemon oil, orange oil, Japanese mint, *cassia*, caraway, cognac, jasmin, chamomile, menthol, ilangilang, sage, fennel, piment, ginger, *anise*, coriander, coffee, and mint oils from a species of the genus *Mentha*. Mint oils useful in the tobacco beads include spearmint and peppermint.

Core

Core 110 can have any suitable diameter. In some cases, core 110 can be a lozenge core. In some cases, core 110 has a diameter of between 300 micrometers and 5 millimeters. In some cases, core 110 has a diameter of between 400 micrometers and 4 millimeters, between 500 micrometers and 3 millimeters, or between 1 millimeter and 2 millimeters. In some cases, core 110 includes a starch, a carbohydrate, a water soluble polymer, a flavorant, a salt, or a combination thereof. For example, a carbohydrate can include one or more sugars, such as glucose, lactose, or sucrose. For example, a water soluble polymer can include starches and cellulose fibers. In some cases, core 110 can consist essentially of starch, sugar, and optionally one or more flavorants. In some cases, core 110 is granulated sugar. Salts can include, for example, a citric acid salt and/or sodium chloride. Flavorants used as a core can include, for example, herbs, spices or teas. In some cases, core 110 is tobacco free. In some cases, core 110 can include tobacco. For example, core 110 can include a pressed core of tobacco powder. In some cases, core 110 can include tobacco particles within a matrix of other constituents. In some cases, core 110 can include sugar spheres having a 2 mm diameter formed from sucrose and starch, which can be obtained from the Paulaur Corporation, located in Cranbury, N.J.

In some cases, core 110 can include gel cores including a plurality of ingredients or components. Gel cores can contain soluble or insoluble gels. The amount of water retained in the gels depend on the properties desired in the finished product. In some cases, gel cores can include tobacco particles dispersed within the cores. Exemplary gel binders for soluble and insoluble gels include kappa carrageenan, sodium alginate, carboxymethyl cellulose, gelatin, pectin, agar, and starches. Soluble gels can be formed by dissolving a gel binder at an elevated temperature, e.g., kappa carrageenan at 180° F., and optionally adding other ingredients, such as a carbohydrate or tobacco particles to this solution while continuing vigorous mixing. The hot mixture is then deposited into a mold to form a plurality of cores. Gelatin provides a weak gel at room temperature but firmness and stability can be increased by the addition of agar or starches. Other gelling binders may be used in a similar manner. Insoluble gels can be formed by the addition of a cross-linking agent to a predissolved solution or slurry. The solution is deposited into a mold to form a plurality of cores and sets up through cooling and/or drying. In most cases, it is necessary to maintain the solution at a high temperature, e.g., greater than 180° F., to prevent premature gelation prior to deposition into the mold. After the gel has set into a bead shape, the gel core can be further processed to form the tobacco bead as is or be further dried to a desired water content. Cross-linking agents can include potassium ions for carrageenan, calcium ions for alginates and low methoxy pectins, and trivalent ions such as aluminum for carboxymethyl cellulose. In insoluble gels (i.e., those that do not orally disintegrate), flavor compounds may leach out of the gel as it is held or chewed in the mouth. For example, the gel beads disclosed in U.S. Patent Application Publication Nos. 2006/0191548 and 2008/0029110 can be used as cores.

Tobacco-Containing Layer(s)

Tobacco bead 100 includes at least one tobacco-containing layer 120 surrounding core 110. In some cases, core 110 and at least one tobacco-containing layer 120 are composed of similar materials. For example, both core 110 and tobacco-containing layer 120 can include greater than 30 weight percent starch. In some cases, as shown in FIG. 1, tobacco bead 100 can include a single layer surrounding core 110. Tobacco-containing layer 120 includes less than 15 weight percent tobacco. Additional ingredients in tobacco-containing layer 120 can include flavorants, pH adjusters, sweeteners, fillers, plasticizers, emulsifiers, binders, pigments, surfactants, lipids, and/or disintegrators.

Tobacco-containing layer 120 is adapted to dissolve within an adult tobacco consumer's mouth. In some cases, tobacco-containing layer 120 can include one or more ingredients selected from the group consisting of starch, konjac, collagen, inulin, soy protein, whey protein, casein, wheat gluten, carrageenan, alginates, propylene glycol alginate, xanthan, dextran, pullulan, curdlan, gellan, locust bean gum, guar gum, gum arabic, tara gum, gum tragacanth, pectin, agar, zein, karaya, gelatin, *psyllium* seed, chitin, chitosan, gum *acacia*, polyvinyl pyrrolidone, polyethylene oxide, polyvinyl alcohol, soluble fiber (e.g., maltodextrin), sugar alcohols (e.g., mannitol, sorbitol), polysorbates, salts, and/or starch. Suitable salts include sodium chloride, citric acid salt, monosodium glutamate, and sodium carbonate.

Suitable plasticizers include propylene glycol, triacetin, glycerin, vegetable oil, triglycerides, or a combination thereof.

Suitable sweeteners include both natural and artificial sweeteners. Suitable natural sweeteners include sugars, for example, monosaccharides, disaccharides, and/or polysaccharide sugars, and/or mixtures of two or more sugars. In some cases, tobacco bead 100 includes one or more of the following in tobacco-containing layer 120, core 110, and/or outer shell 130: sucrose or table sugar; honey or a mixture of low molecular weight sugars not including sucrose; glucose or grape sugar or corn sugar or dextrose; molasses; corn sweetener; corn syrup or glucose syrup; fructose or fruit sugar; lactose or milk sugar; maltose or malt sugar or maltobiose; sorghum syrup; mannitol or manna sugar; sorbitol or d-sorbite or d-sobitol; fruit juice concentrate; and/or mixtures or blends of one or more of these ingredients. Tobacco bead 100 can also include non-nutritive sweeteners in tobacco-containing layer 120, core 110, and/or outer shell 130. Suitable non-nutritive sweeteners include: *stevia*, saccharin; aspartame; sucralose; or acesulfame potassium.

Tobacco-containing layer 120 can include starch. In some cases, tobacco-containing layer 120 includes at least 20 weight percent starch. In some cases, tobacco-containing layer 120 includes between 20 weight percent and 50 weight percent of starch. For example, tobacco-containing layer 120 can include about 35 weight percent starch. In some cases, tobacco bead 100 can include a starch core and include a total starch content of between 35 weight percent and 40 weight percent. Starch in amounts provided herein can inhibit throat burn and/or site burn when combined with amounts of tobacco provided herein. In some cases, tobacco-containing layer 120 can include pH adjustors.

Tobacco-containing layer 120 can include sugar alcohols. In some cases, tobacco-containing layer 120 includes one or more sugar alcohols. Exemplary sugar alcohols include sorbitol, mannitol, xylitol, and erythritol. In some cases, tobacco-containing layer 120 includes at least 25 weight percent of one or more sugar alcohols. In some cases, tobacco-containing layer 120 includes between 25 weight percent and 50 weight percent of one or more sugar alcohols. In some cases, tobacco-containing layer 120 includes between 30 weight percent and 50 weight percent of one or more sugar alcohols. In some cases, tobacco-containing layer 120 includes at least 25 weight percent of mannitol. In some cases, tobacco-containing layer 120 includes between 25 weight percent and 50 weight percent of mannitol. In some cases, tobacco-containing layer 120 includes between 30 weight percent and 50 weight percent of mannitol. The mixture of the sugar alcohol(s), starch, and tobacco in amounts provided herein can minimize throat burn and/or site burn while still providing an adult tobacco consumer with a satisfying tobacco experience. In some cases, tobacco bead 100 can include a total mannitol content of between 30 weight percent and 35 weight percent. Sugar alcohols in amounts provided herein can inhibit throat burn and/or site burn when combined with amounts of tobacco and starch provided herein.

Tobacco-containing layer 120 can include soluble fiber. In some cases, tobacco-containing layer 120 includes between 1 weight percent and 20 weight percent of one or more soluble fibers, between 5 weight percent and 15 weight percent of one or more soluble fibers, or between 8 weight percent and 10 weight percent of one or more soluble fibers. Suitable soluble fibers include maltodextrin, *psyllium*, pectin, guar gum, gum arabic, inulin, arabinoxylans, cellulose, and many other plant components such as resistant starch, resistant dextrins, lignin, pectins, beta-glucans, and oligosaccharides or a combination thereof. In some cases, tobacco-containing layer 120 includes a digestion-resistant soluble fiber. A digestion resistant soluble fiber can include starch linkages that remain undigested by enzymes of the human digestive tract. In some cases, tobacco-containing layer 120 includes a digestion-resistant maltodextrin. Suitable maltodextrins can include those that are soluble in water up to 70% at 20° C., have a viscosity of about 15 cps for a 30% solution at 30° C., a DE in the range of about 6-16, and contain random $\alpha$-1,2, $\alpha$-1,3, $\alpha$-1,4, $\beta$-1,2, $\beta$-1,3 and $\beta$-1,4 glucose linkages in addition to the normal $\alpha$-1,4 glucose linkages found in partially hydrolyzed starch. See, e.g., U.S. Pat. Nos. 5,410,035 and 5,380,717, which are hereby incorporated by reference.

In some cases, tobacco bead 100 includes a plurality of tobacco-containing layers surrounding core 100. For example, two adjacent tobacco containing layers can each include the same amounts of tobacco particles, starch, mannitol, and maltodextrin, but have different flavorants and/or sweeteners. In some cases, not specifically shown, tobacco bead 100 can include any number of layers in which the layers can each have the same or different constituents in different orders. For example, a tobacco bead could include six or more alternating layers in which every other layer includes tobacco particles, each successive layer includes a different flavorant, and the binder varies between layers so different layers dissolve at different rates. When multiple layers of the same composition are deposited, however, it can be difficult to differentiate between successively added layers that can make up tobacco-containing layer 120.

Depending on the desired characteristics, each layer may also include fillers (e.g., di-calcium phosphate, lactose, and microcrystalline cellulose), calcium carbonate, sodium carbonate, dicalcium phosphate, calcium sulfate, and clays), lubricants (e.g., lecithin, stearic acid, hydrogenated vegetable oil, mineral oil, polyethylene glycol 4000-6000 (PEG), sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides)), plasticizers (e.g., glycerine, propylene glycol, polyethylene glycol, sorbitol, mannitol, triacetin, and 1,3 butane diol), stabilizers (e.g., ascorbic acid and monosterol citrate, BHT, or BHA), artificial sweeteners (e.g., sucralose, saccharin, and aspartame), disintegrating agents (e.g., sodium starch glycolate, cross caramellose, cross linked PVP), or other compounds (e.g., vegetable oils, surfactants, and preservatives). Some compounds display functional attributes that fall into more than one of these categories. For example, propylene glycol can act as both a plasticizer and a lubricant and sorbitol can act as both a filler and a plasticizer.

Tobacco-containing layer 120 can also include remnants of food grade solvent or suspension fluid used during a coating process. For example, the food grade solvent or suspension fluid can allow for the spraying of the binder within a fluid bed processor. A majority of the solvent or suspension fluid is generally evaporated during the coating process to form the layers of the tobacco bead, but trace amounts can remain. The solvent or suspension fluid can have a latent heat of vaporization of at least 300 KJ/Kg. In some cases, the solvent or suspension fluid can have a latent heat of vaporization of between 500 KJ/Kg and 2500 KJ/Kg (e.g., between 800 and 2300 KJ/Kg, between 500 and 1300 KJ/Kg, or between 1300 and 2500 KJ/Kg). For example, the latent heat of vaporization of ethanol is 841 KJ/Kg and the latent heat of vaporization of water is 2260 KJ/Kg. Typical, solvents or suspension fluids include water, ethanol, methanol, isopropynol, acetone, and combinations thereof.

Tobacco

Tobacco-containing layer 120 includes less than 15 weight percent tobacco. In some cases, tobacco-containing layer 120 includes less than 14 weight percent tobacco, less than 13 weight percent tobacco, less than 12 weight percent tobacco, or less than 11 weight percent tobacco. In some cases, tobacco-containing layer 120 includes between 5 weight percent tobacco and 14 weight percent tobacco, between 8 weight percent tobacco and 12 weight percent tobacco, or between 10 weight percent tobacco and 11 weight percent tobacco. In some cases, each tobacco-containing layer includes less than 15 weight percent tobacco, less than 14 weight percent tobacco, less than 13 weight percent tobacco, less than 12 weight percent tobacco, or less than 11 weight percent tobacco. The tobacco can also be uniformly dispersed in each tobacco-containing layer. Tobacco bead 100 can include between 30 mg and 100 mg of tobacco in sum.

Tobacco in tobacco-containing layer 120 can be selected from any suitable tobacco. In some cases, tobacco in tobacco-containing layer 120 includes tobacco powder. The tobacco can be a tobacco powder having an average particle size of less than 500 micrometers, less than 400 micrometers, less than 300 micrometers, less than 250 micrometers, less than 200 micrometers, less than 150 micrometers, less than 100 micrometers, less than 50 micrometers, less than 40 micrometers, or less than 30 micrometers. In some cases, a maximum particle size for a tobacco powder used in a tobacco bead provided herein can be less than 1 millimeter, less than 500 micrometers, less than 400 micrometers, less than 300 micrometers, less than 250 micrometers, less than 200 micrometers, less than 150 micrometers, or less than 120 micrometers. For example, a tobacco powder used in tobacco-containing layer 120 can have an average particle size of about 27 micrometers and a largest particle size of about 120 micrometers. Tobacco plant tissue can be processed to a desired size (e.g., a desired particle size).

Tobacco-containing layer 120 can include any suitable tobacco plant tissue (e.g., tobacco particles). Suitable tobaccos include fermented and unfermented tobaccos. In addition to fermentation, the tobacco can be processed using other techniques. For example, tobacco can be processed by heat treatment (e.g., cooking, toasting), flavoring, enzyme treatment, expansion and/or curing. Both fermented and non-fermented tobaccos can be processed using these techniques. In other embodiments, the tobacco can be unprocessed tobacco. Specific examples of suitable processed tobaccos include dark air-cured, dark fire cured, burley, flue cured, and cigar filler or wrapper, as well as the products from the whole leaf stemming operation. In some embodiments, the tobacco fibers includes up to 70% dark tobacco on a fresh weight basis. For example, tobacco can be conditioned by heating, sweating and/or pasteurizing steps as described in U.S. Publication Nos. 2004/0118422 or 2005/0178398. Fermenting typically is characterized by high initial moisture content, heat generation, and a 10% to 20% loss of dry weight. See, e.g., U.S. Pat. Nos. 4,528,993; 4,660,577; 4,848,373; and 5,372,149. In addition to modifying the aroma of the leaf, fermentation can change either or both the color and texture of a leaf. Also during the fermentation process, evolution gases can be produced, oxygen can be taken up, the pH can change, and the amount of water retained can change. See, for example, U.S. Publication No. 2005/0178398 and Tso (1999, Chapter 1 in Tobacco, Production, Chemistry and Technology, Davis & Nielsen, eds., Blackwell Publishing, Oxford). Cured, or cured and fermented tobacco can be further processed (e.g., cut, expanded, blended, milled or comminuted) prior to incorporation into the oral tobacco product. The tobacco, in some embodiments, is long cut fermented cured moist tobacco having an oven volatiles content of between 48 and 50 weight percent prior to mixing with the mouth-stable polymer and optionally flavorants and other additives.

Tobacco in tobacco-containing layer 120 can, in some cases, be prepared from plants having less than 20 μg of DVT per $cm^2$ of green leaf tissue. For example, the tobacco fibers can be selected from the tobaccos described in U.S. Patent Publication No. 2008/0209586, which is hereby incorporated by reference. Tobacco beads 100 containing tobacco from such low-DVT varieties can exhibit improved flavor characteristics in sensory panel evaluations when compared to tobacco beads that do not have reduced levels of DVTs.

Green leaf tobacco can be cured using conventional means, e.g., flue-cured, barn-cured, fire-cured, air-cured or sun-cured. See, for example, Tso (1999, Chapter 1 in Tobacco, Production, Chemistry and Technology, Davis & Nielsen, eds., Blackwell Publishing, Oxford) for a description of different types of curing methods. Cured tobacco is usually aged in a wooden drum (i.e., a hogshead) or cardboard cartons in compressed conditions for several years (e.g., two to five years), at a moisture content ranging from 10% to about 25%. See, U.S. Pat. Nos. 4,516,590 and 5,372,149. Cured and aged tobacco then can be further processed. Further processing includes conditioning the tobacco under vacuum with or without the introduction of steam at various temperatures, pasteurization, and fermentation. Fermentation typically is characterized by high initial moisture content, heat generation, and a 10 to 20% loss of dry weight. See, e.g., U.S. Pat. Nos. 4,528,993, 4,660,577, 4,848,373, 5,372,149; U.S. Publication No. 2005/0178398; and Tso (1999, Chapter 1 in Tobacco, Production, Chemistry and Technology, Davis & Nielsen, eds., Blackwell Publishing, Oxford). Cure, aged, and fermented tobacco can be further processed (e.g., cut, shredded, expanded, or blended). See, for example, U.S. Pat. Nos. 4,528,993; 4,660,577; and 4,987,907.

Tobacco plant tissue used in a tobacco bead provided herein can have a total oven volatiles content of about 1% by weight or greater; about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight. Those of skill in the art will appreciate that "moist" tobacco typically refers to tobacco that has an oven volatiles content of between about 40% by weight and about 60% by weight (e.g., about 45% by weight to about 55% by weight, or about 50% by weight). As used herein, "oven volatiles" are determined by calculating the percentage of weight loss for a sample after drying the sample in a pre-warmed forced draft oven at 110° C. for 3.25 hours. The tobacco bead can have a different overall oven volatiles content than the oven volatiles content of the tobacco fibers used therein. The processing steps described herein can reduce or increase the oven volatiles content.

An herbal cellulose replacement to tobacco can also be used. This could provide a product that could include or not include tobacco-derived nicotine. Herbal cellulose replacements could be cut/ground to similar particle sizes of tobacco for the product to dissolve. Another alternative would be to use starch and/or fiber materials in place of tobacco.

Outer Shell

Outer shell 130 can optionally be provided on a tobacco bead provided herein. Outer shell 130 can serve as a moisture barrier to inhibit volatiles from escaping from tobacco bead 100. Outer shell 130 can also serve as a moisture barrier against moisture soaking in. Outer shell 130 can, in some cases, provide a glossy or semi-glossy appearance, a smooth surface, and/or an appealing visual aesthetic (e.g., a nice color). In some cases, outer shell 130 can include binders, sweeteners, emulsifiers, plasticizers, sweeteners, and/or flavorants. In some cases, outer shell 130 can provide a hard outer coating. For example, a binder selected from the group consisting of methylcellulose, hydroxypropyl methylcellulose, carboxymethyl cellulose, and/or ethyl cellulose can provide a hard outer coating. In some cases, outer shell 130 can provide a soft mouth feel. For example, a binder selected from the group consisting of Beeswax, Zein, acetylated monoglyceride, and/or hydroxypropylated potato starch can provide a soft mouth feel. In some cases, outer shell 130 includes a colorant, such as titanium dioxide, caramel coloring, or other suitable colorant. In some cases, the outer shell can include one or more lipids. In some cases, the outer shell is substantially free of tobacco. In some cases, outer shell 130 can include hydroxypropyl methyl cellulose, which can be obtained from the Ashland Dow Chemical Company under the trade names HPMC E5, E15, and K4M.

Outer shell 130 can give tobacco beads 100 desired bulk properties. For example, outer shell 130 can include a sticky coating that allows a user to pinch a plurality of tobacco beads 100 together prior to use. In some cases, tobacco beads 100 can include an outer shell 130 that inhibits bonding between tobacco beads 100, such that the tobacco beads 100 will easily flow.

Smokeless Tobacco Products

As discussed above, tobacco bead 100 can be used alone or combined with other constituents to form part of a larger smokeless tobacco product. A plurality of tobacco beads 100 can, in some cases, be sold alone in packages for direct oral consumption. For example, tobacco beads 100 can be packaged loosely in slide fastener plastic bags, blister packs, portion-control dispensers (e.g., like a pepper grinder), straws or tubes with sealed ends, and box-like containers. For example, a container can have a shape and size approximating that of a cigarette pack or cigarette lighter. In some cases, a plurality of tobacco beads 100 can be packaged in an open or highly porous wrapping material, (e.g., fabrics, paper or plastic films), with or without additional smokeless tobacco product. In some cases, a plurality of tobacco beads 100 can be packaged in a consumable package, (e.g., a pouch made of a pair of edible film strips sealed or adhered together along their edges). For example, the edible film used to produce a consumable package could be of the type described in U.S. Patent Publication No. 2005/0089548, which is hereby incorporated by reference. A plurality of different types of tobacco beads 100 can be packaged together. In some cases, a first plurality of tobacco beads 100 having a first flavor profile are packaged with a second plurality of tobacco beads 100 having a second and different flavor profile. The first and second pluralities of tobacco beads can be visually differentiated by have different exterior colors. Different tobacco bead groups can be mixed or segregated.

Tobacco Bead Formation

The process of forming tobacco bead 100 can vary depending on the specific equipment used, the specific core material, and the materials forming the one or more tobacco-containing layers 120 and outer shell 130. In some cases, the layers are added successively in a single apparatus used for tobacco bead formation. For example, cores can be fluidized and the constituents of each layer added in successive steps, changing the compositions and/or feed rates of each constituent to tailor the composition of each successive layer.

An apparatus that is suitable for tobacco bead formation is a fluid bed processor that contains a rotating plate ("rotor") inside the fluid bed. Cores are fluidized by the rotation of the rotor and by the flow of air through the annular clearance between the rotor and the vessel wall. In some cases, the rotor has a conical upper surface. Tobacco beads 100 can be formed by fluidizing a plurality of preformed cores 110 within the fluid bed rotor processor by rotating the rotor and passing air through the annular clearance between the rotor and the vessel wall.

The components for each layer are then fed to the fluid bed rotor processor to form the one or more layers. The components include dry ingredients (e.g., tobacco powder, starch, mannitol) and solution ingredients (e.g., sweeteners, flavorants). The solution ingredients can be dissolved or suspended in a food or pharmaceutical grade solvent or suspension fluid, which can be evaporated during the coating process. The coating solution or suspension can be sprayed by tangential spray guns. A spray nozzle is suitable for introducing a coating solution or suspension into the fluid bed rotor processor. The spray nozzle can be a currently available nozzle which provides adequate atomization of the coating solution. In some cases, the one or more spray nozzles can include tangential spray guns. In addition to the binder and a food grade solvent or suspension fluid, the coating solution or suspension can include one or more flavorants. In some cases, flavorants can be separately added to the apparatus used for tobacco bead formation. The coating solution can be sprayed into the apparatus used for tobacco bead formation using one or more spray nozzles. In some cases, tobacco particles and/or other dry ingredients can be premixed with the coating solution or suspension and fed sprayed into the fluid bed rotor processor as part of the coating solution or suspension.

Dry ingredients can be separately fed to the fluid bed rotor processor. The dry ingredients include the tobacco particles and other particulate ingredients, e.g., starch, that may be included in one or more layers. The other dry particulate ingredients can serve as fillers, flavorants, disintegrants, binders, colorants to produce layers without tobacco particles (e.g., layer 17 of FIG. 1C). A volumetric powder feeding unit is suitable for feeding the dry ingredients to the fluid bed rotor processor. The dry ingredients can be fed to the fluid bed rotor processor simultaneously with the spraying of the coating solution or suspension. The spraying of the coating solution or suspension and the feeding of the tobacco particles or other dry particulate can also be intermittent.

A fluid bed rotor processor can allow for a uniform distribution of the tobacco particles within the core and/or each layer, efficient drying of the coating solution or suspension to form each layer, and the ability to apply successive layers in a single operation within the fluid bed rotor processor. The processor can also yield tobacco beads having a desired uniformity and conformity in tobacco bead size and layer thickness. The coating conditions can also be controlled by varying the rotor speed, the inlet air temperature, humidity, and/or the air flow rate. The rotor can rotate at a speed of between 50 and 500 revolutions per minute (e.g., between 185 and 325 revolutions per minute). The amount of air passing through the annular clearance can be between 5 and 100 cubic feet per minute (e.g., between 10 and 35 cubic feet per minute). The temperature of air passing through the annular clearance can be between 0 and 100° C. (e.g., between 2° and 70° C.). The speed of rotation of the rotor and/or the amount and/or temperature of air passing through the annular clearance can be varied during the tobacco bead formation process. In some cases, a slit airflow of 10-30 CFM can be used. An example of a fluid bed rotor processor is sold by Vector Corporation (Sloan, Iowa) under the trade name Granurex® (e.g., the GXR35). The Granurex® processor includes a cylindrical vessel and a conical rotor at the base, which rotates around the central axis. Fluid bed processors having a rotor, in particular a conical rotor, can produce tobacco beads having more uniform layers than fluid bed processors that lack a rotor.

Tobacco Experience

Figure 2:
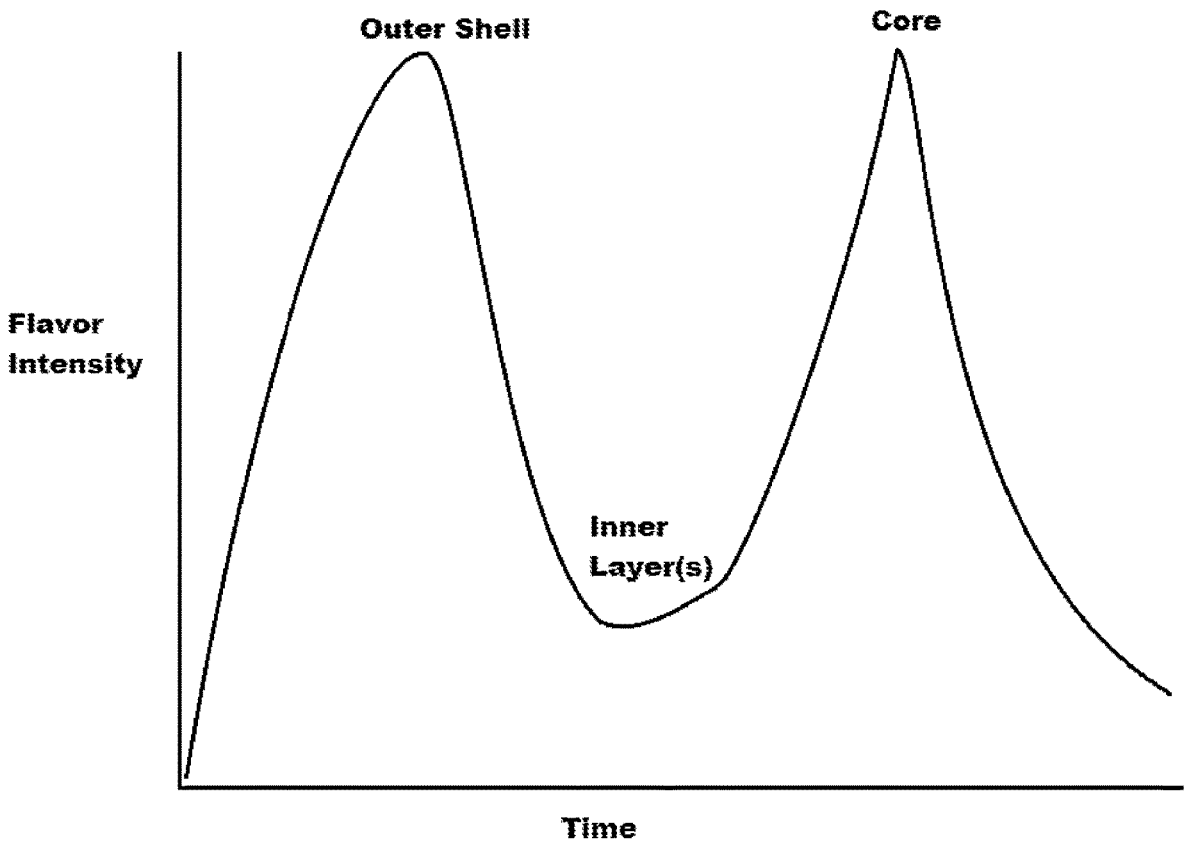
FIG. 2 depicts an exemplary flavor release profiles for an exemplary tobacco bead provided herein.

Tobacco beads 100 can be formulated to release their components as desired to result in a release profile when a tobacco bead 100 is orally consumed by an adult tobacco consumer. Tobacco bead 100 can be made in a process that produces layers of sufficient uniformity and consistency to control the order of component release when the tobacco beads are orally consumed by an adult tobacco consumer. Furthermore, the rate of component release can be controlled by the composition of each layer and/or the core, particularly by the oven volatiles content. These features, either alone or in combination, can result in a tobacco bead providing, when orally consumed, a desired flavor profile. For example, as shown in FIG. 2, an adult consumer consuming a tobacco bead having the approximate structure of the tobacco bead of FIG. 1 can first detect a flavor from outer shell 130, which will peak and then recede, followed by a steady flavor provided by the internal tobacco-containing layer(s) 120, followed by a second flavor spike from core 110, which an adult tobacco consumer can crunch. In some cases, the flavor from core 110 can serve as a breath freshener.

Tobacco beads 100 can be formulated to have different total dissolution times. The total dissolution time of a tobacco bead is based upon, inter alia, the number of layers, the disintegration rates of those layers, the size and composition of the core, and the oven volatiles content. The total dissolution time for a tobacco bead can be between 1 minute and 30 minutes. In some cases, tobacco beads 100 can have a total dissolution time of between 2 minutes and 15 minutes (e.g., between 2 minutes and 4 minutes, between 4 minutes and 8 minutes, or between 8 minutes and 20 minutes).

The flavor release profile and the flavor characteristics of tobacco beads 100 can be evaluated by a sensory panel using techniques known in the art. For example, panelists can be trained and used to evaluate the flavor characteristics of tobacco beads. Fifteen (15) internal Product Developers, who are tobacco consumers between the ages of 21 and 65, were recruited to help evaluate six (6) different tobacco bead prototypes. The test samples consisted of 6 prototypes of tobacco beads, labeled as prototype numbers 8713, 8813, 8613, 81313, 9153 Enviro and 9153 Flo 15. Participants were provided 1 bead per session for testing. This study was carried out as a double-blind, randomized within-subjects design. The participants tested one of the prototypes in each session, with every participant testing all 6 prototypes (as schedule permitted). The order of the prototypes for each participant was randomized. Study participants were restricted from smoking, using other tobacco/nicotine products, drinking beverages, eating food or mints, or chewing gum for thirty (30) minutes prior to the start of each study session. Participants were seated in the test room and trained on how to perform the sensory evaluation at the start of the first session.

At the start of each session, the participant cleansed her/his palate with a cracker and rinsed with water. Once all instructions were reviewed, the participant rated the appearance of the sample on the computerized ballot provided (Compusense Five™). Participants were then instructed to place the sample bead in their mouth, keeping it in the center of their tongue and sucking on it (no chewing). At various time points (30 sec, 2 min, 4 min, 8 min, 12 min and 15 min) they rated each of the following attributes on a line scale anchored at each end: Overall Flavor Intensity, Tobacco Taste, Texture, Site Burn, and Throat Burn. The participants were instructed to use the sample to complete dissolution without spitting, unless they chose to remove it. They were instructed to skip any questions that occur after the sample had completely dissolved, and to record the time that the sample was completely gone. This protocol was repeated no more than 5 times per week on separate days (1 session per day).

The components of each sample were similar, with each sample including a starch/sugar core, and each sample a combination of milled tobacco, starch, mannitol, digestion-resistant maltodextrin, sweeteners, and flavorants. The differences between each sample are shown in the Table I.

TABLE I

| Sample | OV % | Tobacco % | Drying |
|---|---|---|---|
| 8613 | 6% | 10% | 1 hour in fluidizedbed and 20-25 hours in environmental chamber |
| 8713 | 6-7% | 15% | 1 hour in fluidizedbed and 20-25 hours in environmental chamber |
| 8813 | 6-7% | 7-8% | 1 hour in fluidizedbed and 20-25 hours in environmental chamber |
| 81313 | 6-7% | 10% | 1 hours in fluidizedbed and 20-25 hours in environmental chamber |
| 9153 Enviro | 7% | 10% | 1 hours in fluidizedbed and environmental chamber at 70° C., 5-6 hours |
| 9153 Flo 15 | 7% | 10% | 1 hours in fluidizedbed and environmental chamber at 50° C., >10 hours |

Figure 5:
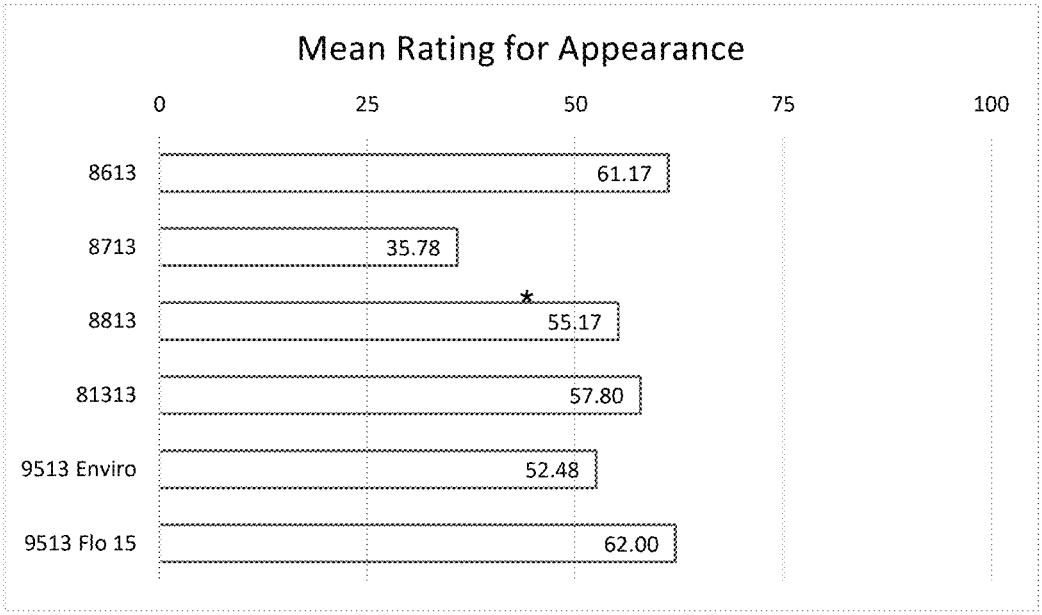
FIG. 5 is a graph depicting a means rating for appearance of tobacco bead samples.

As shown in FIG. 5, all of the tobacco bead samples were rated similarly for appearance except for prototype 8713, which was rated as significantly less appealing than the others ($p<0.05$).

Figure 3A:
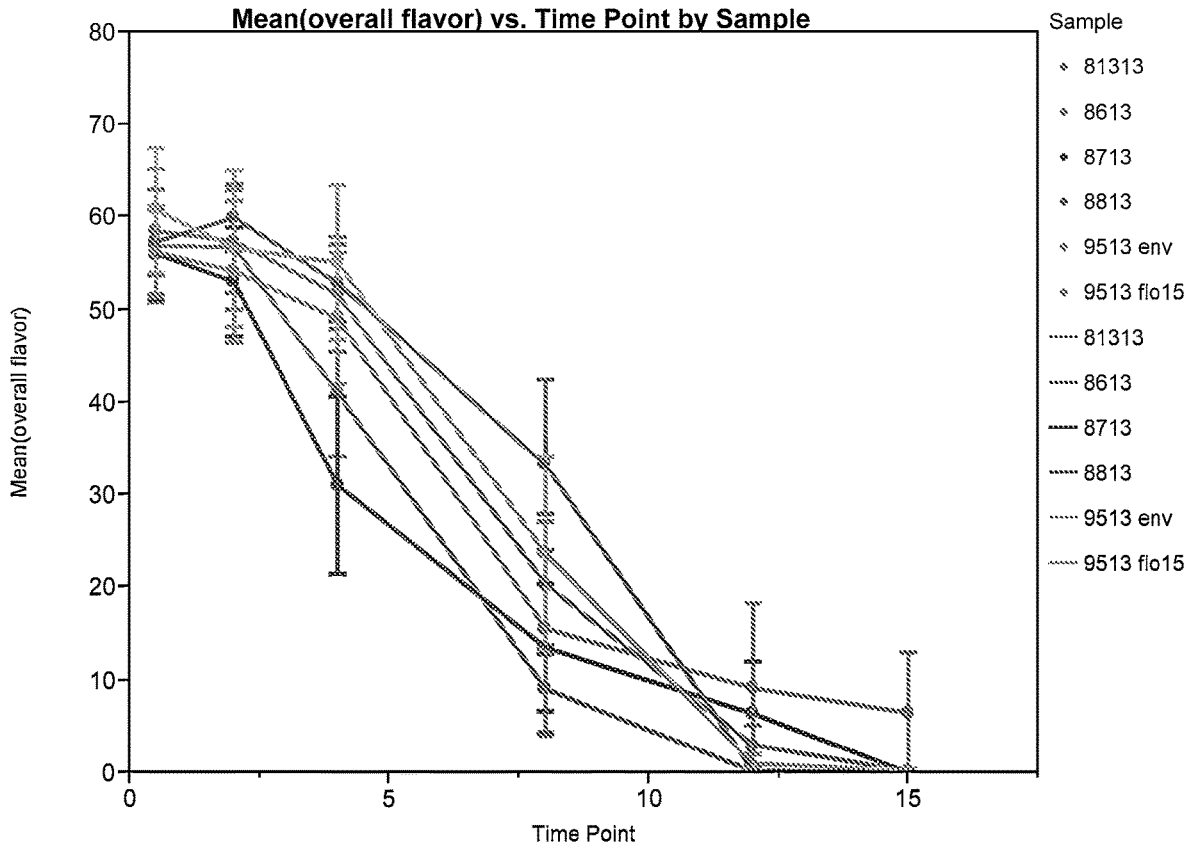
FIGS. 3A-3E depict product characteristics for 6 different tobacco bead prototypes.
Figure 3B:
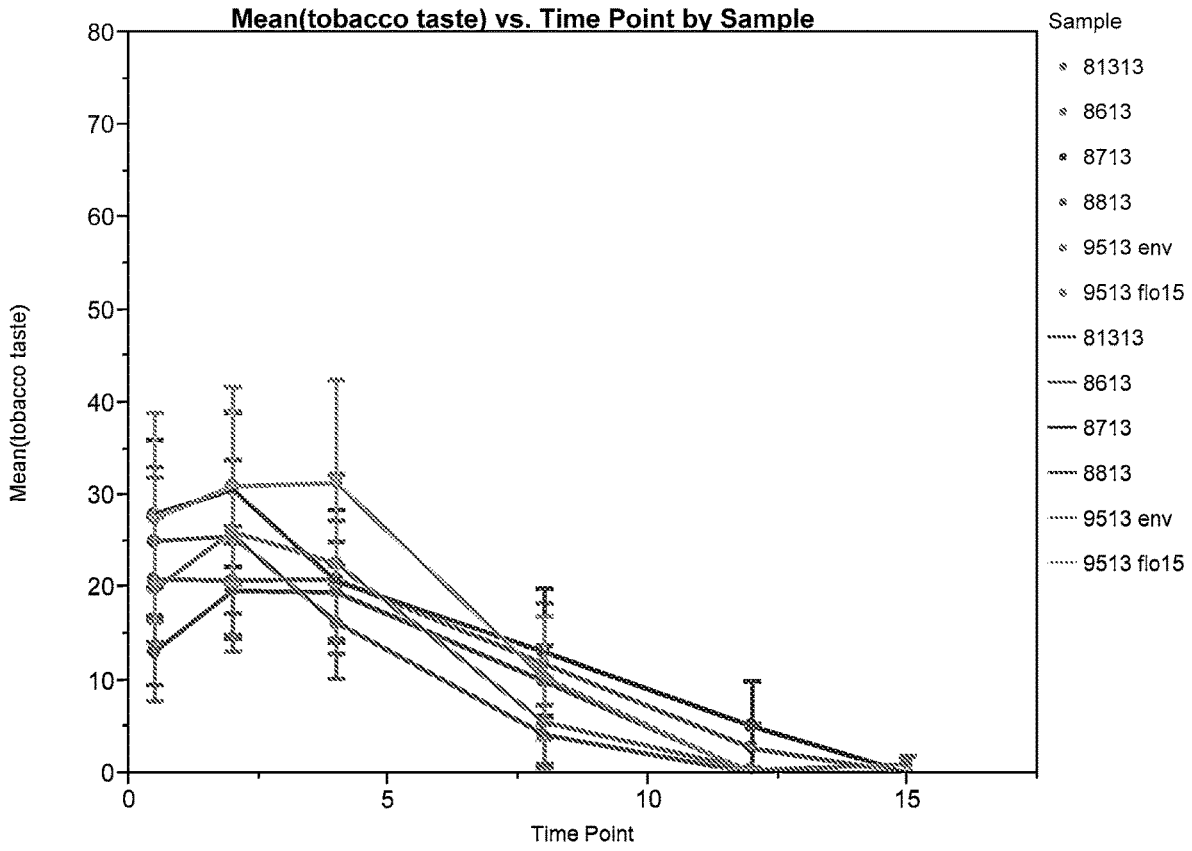
Figure 3C:
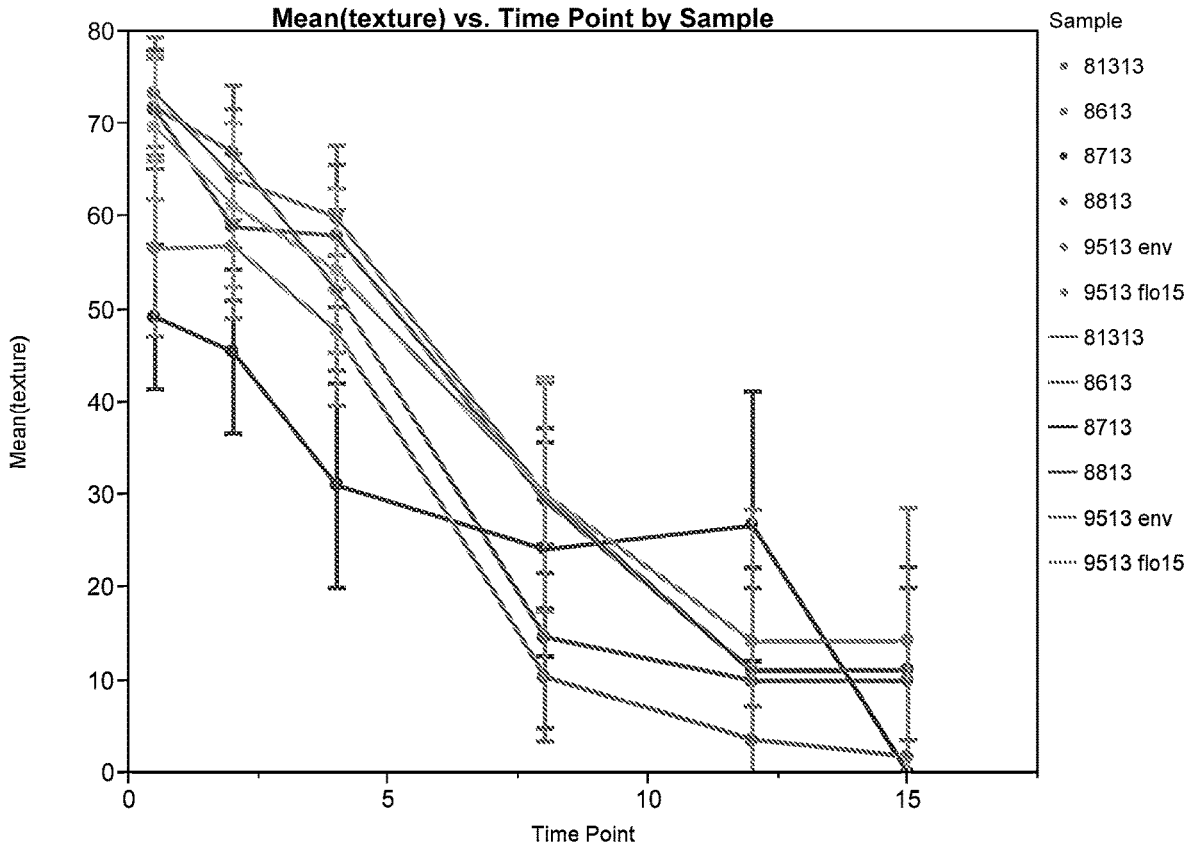
Figure 3D:
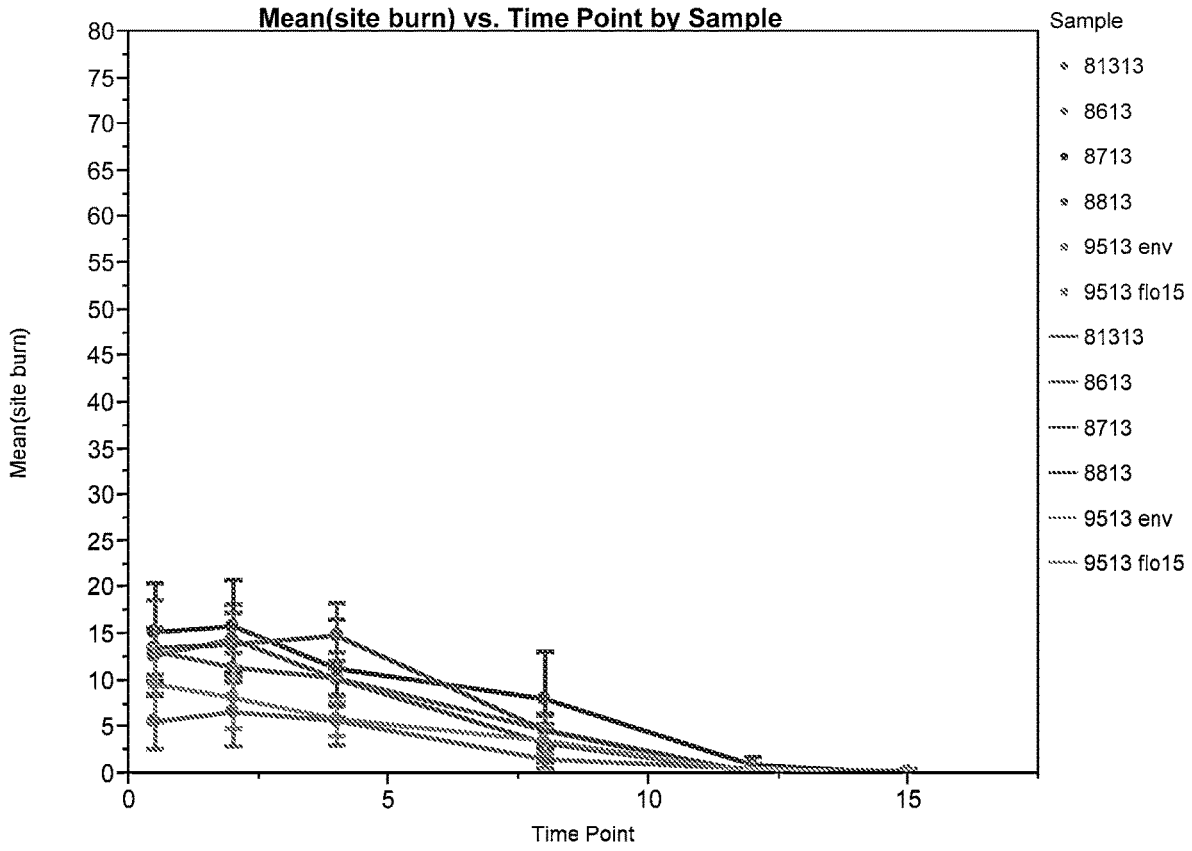
Figure 3E:
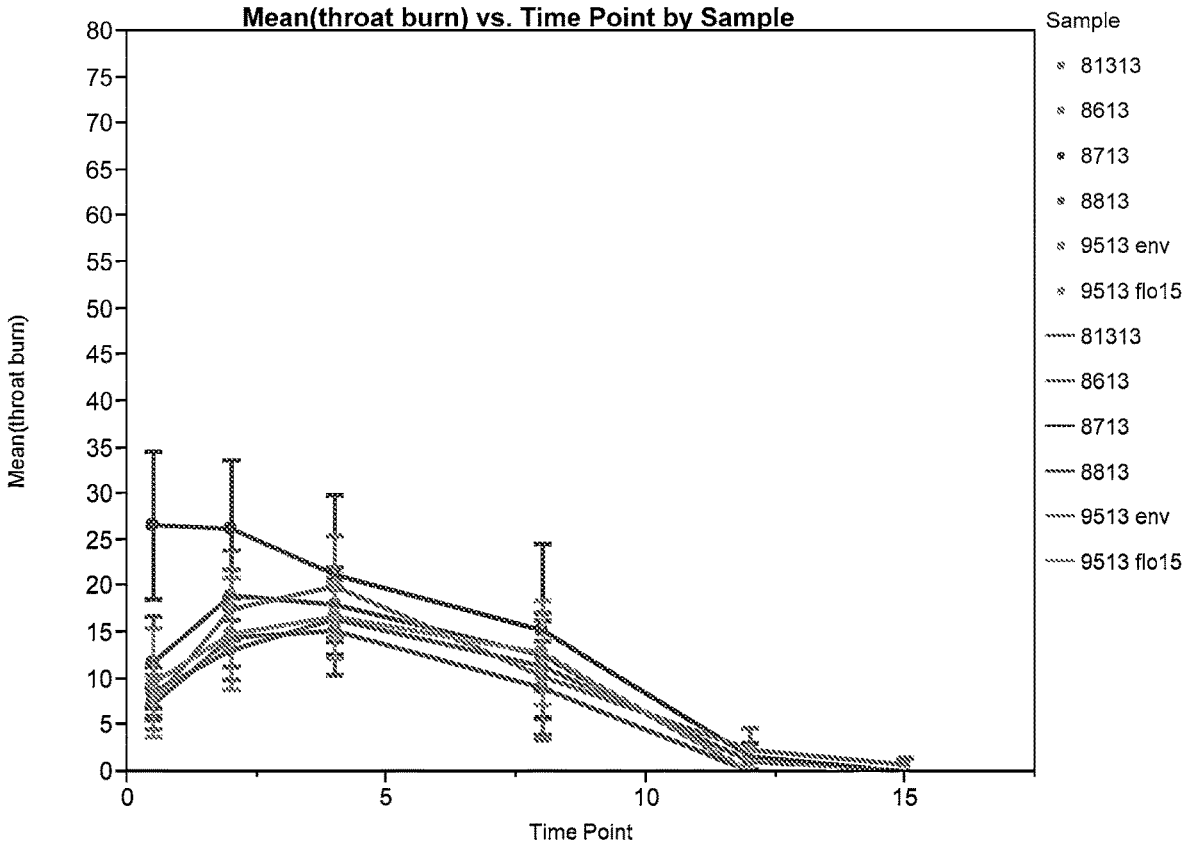
Figure 4A:
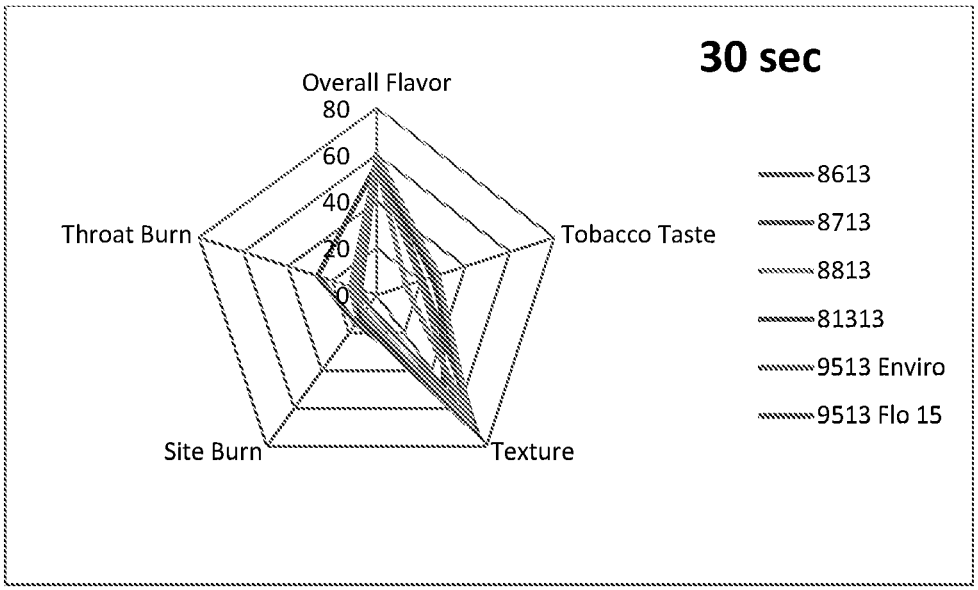
FIGS. 4A-4F depict product characteristics for the 6 different tobacco bead prototypes at different time intervals.
Figure 4B:
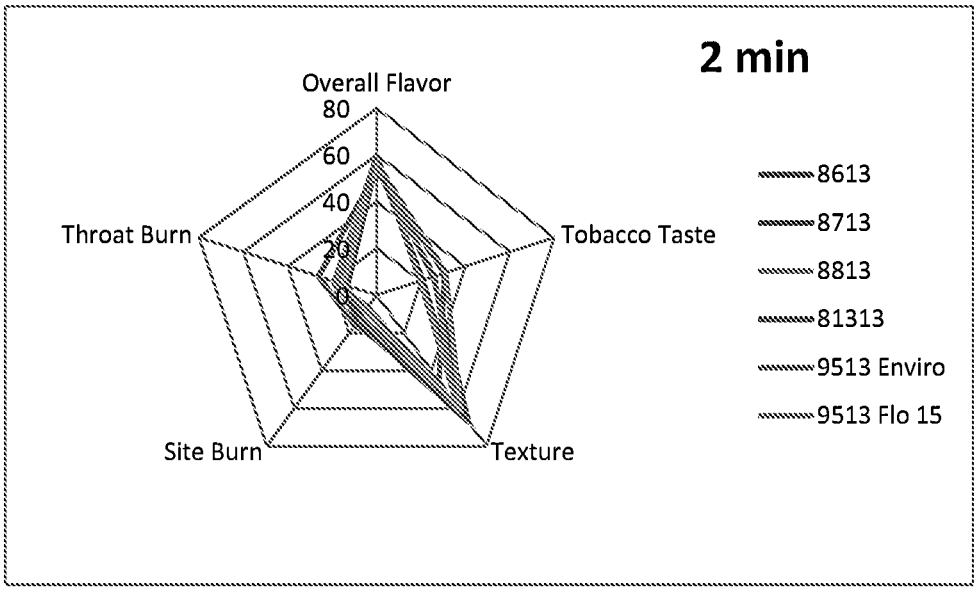
Figure 4C:
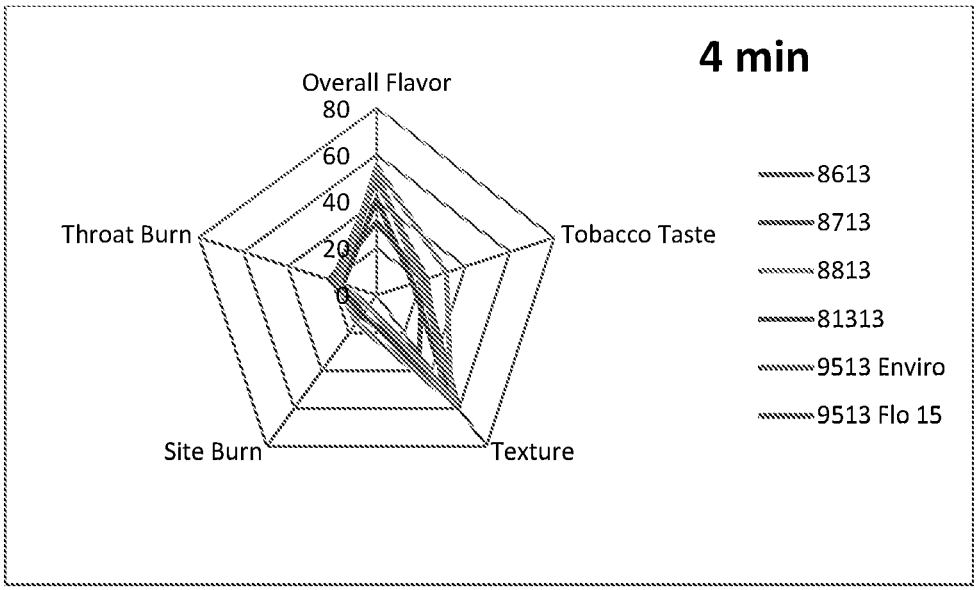
Figure 4D:
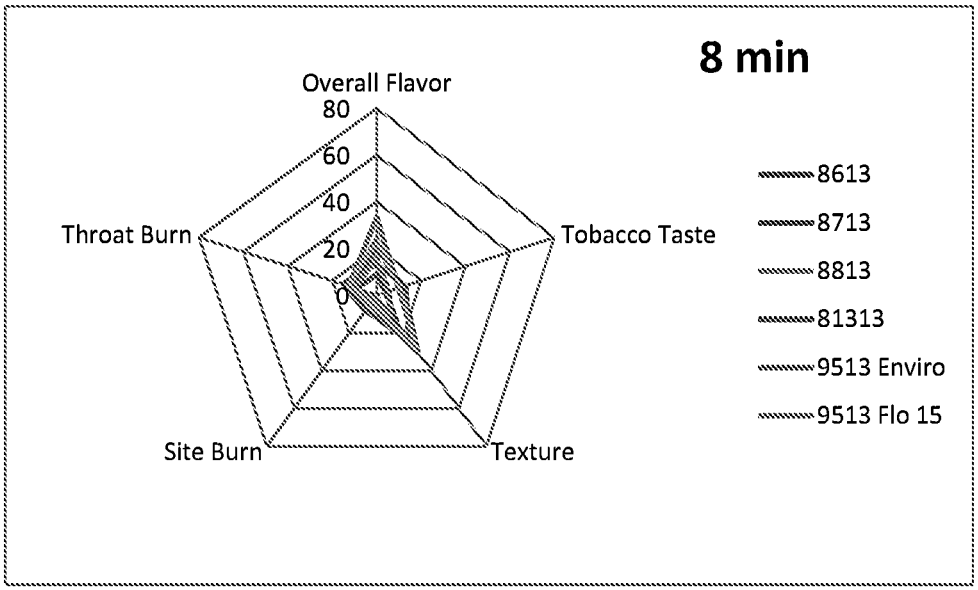
Figure 4E:
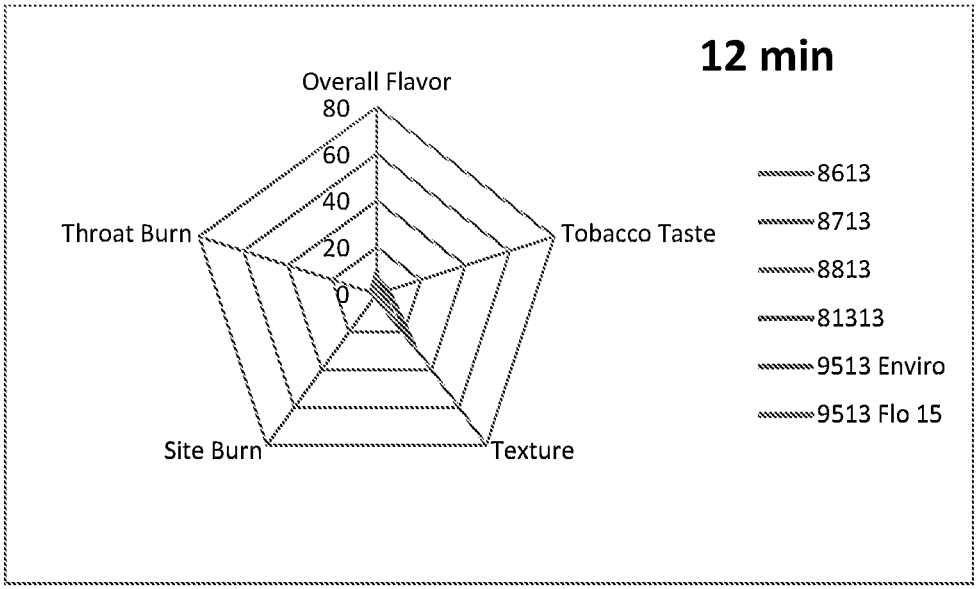
Figure 4F:
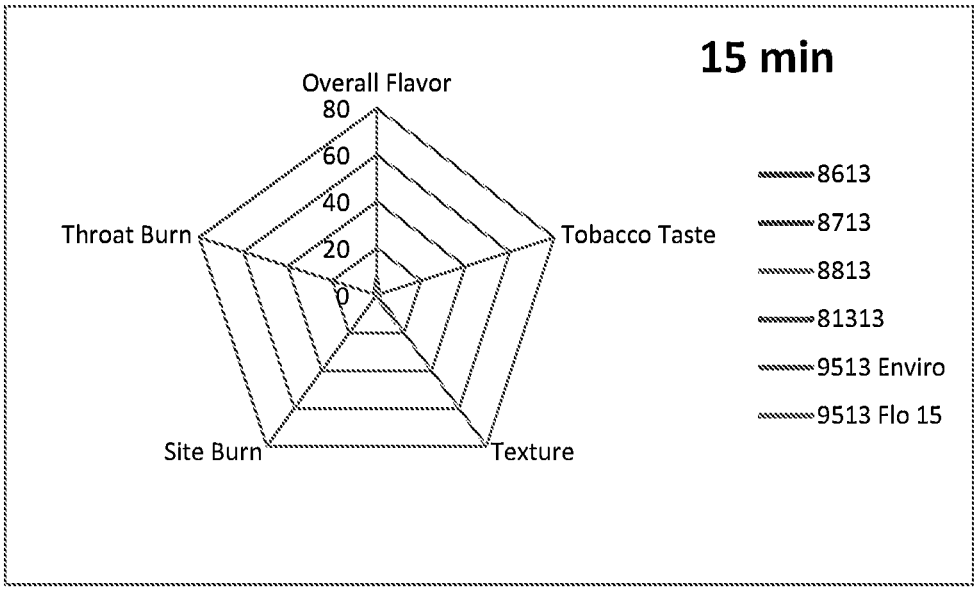

Regarding the attributes, there were no significant differences in the mean attribute ratings for any of the sensory attributes tested in Table III (ANOVA, significance is $p<0.05$). There was a trend toward significance for texture at the 0.5 minute time point and for throat burn at the 0.5 min time point (highlighted cells below). As shown in FIGS. 3C and 3E, a comparison of means (Tukey-Kramer Test) for those two attributes/time points showed that prototype 8713 was rated the lowest for texture (n.s.) and highest for throat burn (n.s.). Sample 8713 also demonstrated higher site burn (FIG. 3D). Regarding tobacco taste (FIG. 3B), sample 8713 demonstrated a tobacco taste comparable to sample 9513 flo 15 despite the fact that sample 8713 had a higher percentage of tobacco. Regarding overall flavor (FIG. 3A), sample 8713 was rated lowest at 4 minutes. FIGS. 4A-4F depict the comparisons of the different samples at different time of use points.

TABLE III

| Attribute | Time Point | P value |
|---|---|---|
| overall flavor | 0.5 | 0.9942 |
| | 2 | 0.9768 |
| | 4 | 0.1691 |
| | 8 | 0.3214 |
| | 12 | 0.5146 |
| | 15 | 0.2107 |
| tobacco taste | 0.5 | 0.7718 |
| | 2 | 0.8922 |
| | 4 | 0.8279 |
| | 8 | 0.821 |
| | 12 | 0.5761 |
| | 15 | 0.1945 |
| texture | 0.5 | 0.0787 |
| | 2 | 0.4632 |
| | 4 | 0.2185 |
| | 8 | 0.7085 |
| | 12 | 0.8378 |
| | 15 | 0.8967 |
| site burn | 0.5 | 0.694 |
| | 2 | 0.4885 |
| | 4 | 0.4573 |
| | 8 | 0.7142 |
| | 12 | 0.6773 |
| | 15 | 0.1945 |
| throat burn | 0.5 | 0.0533 |
| | 2 | 0.4614 |
| | 4 | 0.9718 |
| | 8 | 0.9855 |
| | 12 | 0.539 |
| | 15 | 0.1945 |

TABLE IV

| Duration of Use Summary | |
|---|---|
| Sample | Duration Range (min) |
| 8613 | 5:24-14:08 |
| 8713 | 4:04-13:00* |
| 8813 | 5:20-11:50 |
| 81313 | 5:31-11:01 |
| 9153 Enviro | 6:19-16:50 |
| 9153 Flo 15 | 5:08-14:00 |

*One participant removed this sample at 3:00.

EXAMPLES

Table V below provides ingredients for an exemplary tobacco bead having a diameter of about 10 mm and having a total of about 60 mg of tobacco powder (Example 1) and an exemplary tobacco bead having a diameter of about 8 mm and having a total of about 43 mg of tobacco powder.

TABLE V

| Ingredient | Example 1: 10 mm/60 mg % wt | Example 2: 8 mm/42 mg % wt |
|---|---|---|
| Core (Starch/Sucrose) | ~6% | ~9% |
| Starch in Layers | ~32% | ~32% |
| Mannitol | ~33% | ~32% |
| Salts | <1% | <1% |
| pH adjust agent(s) | <1% | <1% |
| Surfactant(s) | <1% | <1% |
| Digestion Resistant Maltodextrin | ~8% | ~6% |
| Milled Tobacco | ~10% | ~10% |
| Plasticizer | <1% | <1% |
| Sweeteners | ~0.5% | ~0.5% |
| Flavorants | 2-3% | 2-3% |
| Water | <1% | <1% |

TABLE V-continued

| Ingredient | Example 1: 10 mm/60 mg % wt | Example 2: 8 mm/42 mg % wt |
|---|---|---|
| Lipids | ~1% | ~1% |
| HPMC | 3-4% | 3-4% |
| Colorants | <0.2% | <0.2% |

A number of embodiments have been described. Nevertheless, it will be understood that various modifications may be made without departing from the spirit and scope of the invention. Accordingly, other embodiments of the invention are within the scope of the following claims.

We claim:

1. A smokeless tobacco product comprising:

a plurality of tobacco beads, each tobacco bead of the plurality of tobacco beads including, a core, a first tobacco-containing layer at least partially surrounding the core, the first tobacco-containing layer having a first dissolution rate, and a second tobacco-containing layer at least partially surrounding the first tobacco-containing layer, the second tobacco-containing layer having a second dissolution rate that is different from the first dissolution rate, the first tobacco-containing layer and the second tobacco-containing layer each including at least 5 weight percent of tobacco, at least 20 weight percent of a starch, at least 25 weight percent of mannitol, and at least 1 weight percent of maltodextrin, the first tobacco-containing layer further including, a first flavorant, and a first sweetener, and the second tobacco-containing layer further including, a second flavorant, and a second sweetener, the second flavorant being different from the first flavorant, and the second sweetener being different from the first sweetener.

2. The smokeless tobacco product of claim 1, wherein:

the first flavorant includes licorice, wintergreen, cherry, berry type, Dramboui, bourbon, scotch, whiskey, spearmint, peppermint, lavender, cinnamon, *cardamon*, caramel, *apium* graveolents, clove, *cascarilla*, nutmeg, sandalwood, bergamot, *geranium*, honey essence, honey, rose oil, *vanilla*, lemon oil, orange oil, Japanese mint, *cassia*, caraway, cognac, jasmin, chamomile, menthol, ilangilang, sage, fennel, piment, ginger, *anise*, coriander, coffee, mint oils from a species of the genus *Mentha*, honey, or any combination thereof; and the second flavorant includes licorice, wintergreen, cherry, berry type, Dramboui, bourbon, scotch, whiskey, spearmint, peppermint, lavender, cinnamon, *cardamon*, caramel, *apium* graveolents, clove, *cascarilla*, nutmeg, sandalwood, bergamot, *geranium*, honey essence, honey, rose oil, *vanilla*, lemon oil, orange oil, Japanese mint, *cassia*, caraway, cognac, jasmin, chamomile, menthol, ilangilang, sage, fennel, piment, ginger, *anise*, coriander, coffee, mint oils from a species of the genus *Mentha*, honey, or any combination thereof.

3. The smokeless tobacco product of claim 1, wherein:

the first sweetener includes sucrose, honey, glucose, grape sugar, corn sugar, dextrose, molasses, corn sweetener, corn syrup, fructose, lactose, maltose, sorghum syrup, sorbitol, fruit juice concentrate, saccharin, aspartame, sucralose, acesulfame potassium, or any combination thereof; and the second sweetener includes sucrose, honey, glucose, grape sugar, corn sugar, dextrose, molasses, corn sweetener, corn syrup, fructose, lactose, maltose, sorghum syrup, sorbitol, fruit juice concentrate, saccharin, aspartame, sucralose, acesulfame potassium, or any combination thereof.

4. The smokeless tobacco product of claim 1, wherein:

the first tobacco-containing layer includes less than 15 weight percent of the tobacco; and the second tobacco-containing layer includes less than 15 weight percent of the tobacco.

5. The smokeless tobacco product of claim 1, wherein:

the first tobacco-containing layer includes less than 50 weight percent of the starch; and the second tobacco-containing layer includes less than 50 weight percent of the starch.

6. The smokeless tobacco product of claim 1, wherein:

the first tobacco-containing layer includes less than 50 weight percent of the mannitol; and the second tobacco-containing layer includes less than 50 weight percent of the mannitol.

7. The smokeless tobacco product of claim 1, wherein:

the first tobacco-containing layer includes less than 20 weight percent of the maltodextrin; and the second tobacco-containing layer includes less than 20 weight percent of the maltodextrin.

8. The smokeless tobacco product of claim 1, wherein each tobacco bead of the plurality of tobacco beads has a diameter ranging from 1 millimeter to 6 millimeters.

9. The smokeless tobacco product of claim 1, wherein each tobacco bead of the plurality of tobacco beads includes 2 weight percent to 20 weight percent of the core.

10. The smokeless tobacco product of claim 1, wherein the core includes a carbohydrate, a water soluble polymer, a salt, a sugar, sodium alginate, or any combination thereof.

11. The smokeless tobacco product of claim 1, wherein the starch is a first starch, and the core includes a second starch.

12. The smokeless tobacco product of claim 1, wherein the core includes a third flavorant.

13. The smokeless tobacco product of claim 1, wherein the core is free of tobacco.

14. The smokeless tobacco product of claim 1, wherein the core is a pressed core including tobacco powder.

15. The smokeless tobacco product of claim 1, wherein the tobacco is a tobacco powder having an average particle size of less than 500 micrometers.

16. The smokeless tobacco product of claim 1, wherein:

the first tobacco-containing layer includes pH adjusters, fillers, plasticizers, emulsifiers, binders, pigments, surfactant, lipids, disintegrators, or any combination thereof; and the second tobacco-containing layer includes pH adjusters, fillers, plasticizers, emulsifiers, binders, pigments, surfactant, lipids, disintegrators, or any combination thereof.

17. The smokeless tobacco product of claim 1, wherein each tobacco bead of the plurality of tobacco beads further includes an outer shell, the outer shell surrounding the second tobacco-containing layer, the outer shell being configured to reduce escape of volatiles from the core and the tobacco-containing layers.

18. The smokeless tobacco product of claim 17, wherein the outer shell is free of tobacco.

19. The smokeless tobacco product of claim 17, wherein the outer shell includes carboxymethyl cellulose, hydroxypropyl cellulose, hydroxyethyl cellulose, hydroxypropyl methyl cellulose, methyl cellulose, or any combination thereof.

20. The smokeless tobacco product of claim 1, where in at least one tobacco bead of the plurality of tobacco beads further comprises a third tobacco-containing layer at least partially surrounding the second tobacco-containing layer, the third tobacco-containing layer having a third dissolution rate that is different from the first dissolution rate, the second dissolution rate, or both the first dissolution rate and the second dissolution rate, the third tobacco-containing layer including a third sweetener that is different from the first sweetener, the second sweetener, or both the first sweetener and the second sweetener, and the third tobacco-containing layer including a third flavorant that is different from the first flavorant, the second flavorant, or both the first flavorant and the second flavorant.

* * * * *